United States Patent [19]

Hutter

[11] 3,967,152

[45] June 29, 1976

[54] SIMULTANEOUS ELECTROSTATIC FOCUSING AND DEFLECTION SYSTEM

[75] Inventor: Rudolf G. E. Hutter, New York, N.Y.

[73] Assignee: GTE Laboratories Incorporated, Waltham, Mass.

[22] Filed: July 17, 1975

[21] Appl. No.: 596,323

Related U.S. Application Data

[62] Division of Ser. No. 473,591, May 28, 1974, Pat. No. 3,922,580.

[52] U.S. Cl. ..... 313/435; 315/15

[51] Int. Cl.[2] ..... H01J 29/74; H01J 29/62

[58] Field of Search ..... 313/421, 426, 427, 435, 313/439

[56] References Cited

UNITED STATES PATENTS 2,617,077 11/1952 Schlesinger ..... 313/427 X

*Primary Examiner*—Robert Segal

*Attorney, Agent, or Firm*—Irving M. Kriegsman; Leslie J. Hart

[57] ABSTRACT

A cylindrical electrode for use in focusing and deflecting an electron beam is provided about its central section with eight mutually separated electrode segments arranged in a diametrical fashion for deflecting the beam, and with first and second cylindrical electrode sections at opposite ends of the electrode for focusing the electron beam.

1 Claim, 3 Drawing Figures

SIMULTANEOUS ELECTROSTATIC FOCUSING AND DEFLECTION SYSTEM

This is a division, of application Ser. No. 473,591 filed May 28, 1974, now U.S. Pat. No. 3,922,580, granted 11/25/75.

BACKGROUND OF THE INVENTION

1. Field of the Invention

This invention relates to an elect ostatic focusing and deflection system for use with electron beams, and especially with electron beams in cathode-ray tubes.

2. Description of the Prior Art

It is well known that a uniform longitudinal magnetic field, generated for instance by a long solenoid, focuses an electron beam. It is also well known that transverse magnetic fields, as generated by either saddle-shaped coils or toroidal coils, deflect an electron beam. Furthermore, a combination of both types of fields, as used in certain types of vidicons, can focus and deflect an electron beam simultaneously, along an axial region of a beam device where both the solenoid and deflection coils are located. The necessary independence of focusing and deflection action is achievable for magnetic fields because of the small coupling that exists between the focusing and deflection coils.

Simultaneous electrostatic focusing and deflecting cannot be achieved, using conventional electrode structures as focusing electrostatic lenses or deflection fields, such as cylinders and apertured disks of lenses and parallel or bent plates of deflecting systems. The electrode structures necessary for creation of one field will tend to mask any additional field which one attempts to superimpose upon the first field.

In U.S. Pat. No. 2,312,723 to Llewellyn, there was disclosed a composite cylindrical electrode having different potentials imposed upon different parts of the electrode in order to produce a parallel accelerating field. No selective deflection was provided by this electrode.

U.S. Pat. No. 2,453,647 to Van Overbeek teaches the use of a zigzag-shaped line of demarcation to divide two adjacent electrostatic deflecting members.

U.S. Pat. No. 3,397,341 teaches the use of a conical electrostatic deflector comprising four deflection electrode segments, each segment including a cutout into which is extended a protrusion from an annular conducting portion at one end of the electrode segments.

U.S. Pat. Nos. 3,678,316 and 3,678,320 to Barten teach the use of grid in a cathode-ray tube having boundaries between them in a sinusoidal shape.

It has, however, remained a problem to superimpose two electrostatic fields for simultaneous electrostatic focusing and deflection of a single electron beam.

SUMMARY OF THE INVENTION

For electrostatic deflection, the present invention provides eight electrodes around a cylindrical surface for use in providing an electrostatic deflecting field. The boundaries of each of these electrodes provide a means for insulating the electrodes from their surroundings. Adjacent cylindrical sections of the electrode are provided for use with separately selected potentials. Depending upon the potentials selected for the adjacent elements, the electrode configuration may have the characteristic of a nearly rotationally symmetrical Einzel lens, or it may have the characteristics of a bipotential lens.

DESCRIPTION OF THE PREFERRED EMBODIMENT

Figure 1:
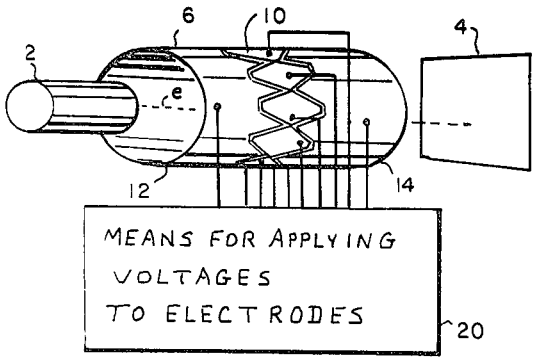
FIG. 1 is an overall schematic diagram of an electrode system according to the present invention used to focus and deflect an electron beam while it passes from a cathode to a screen.
Figure 2:
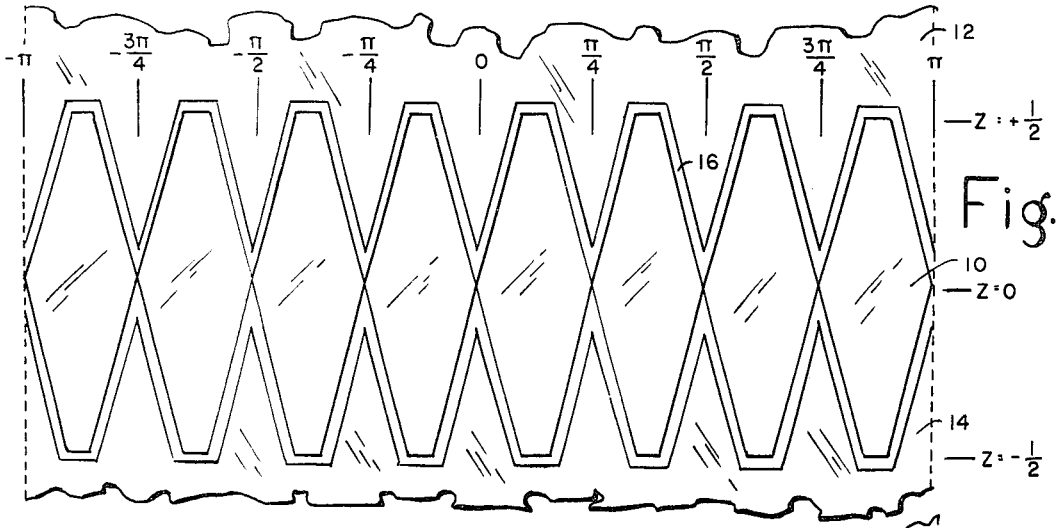
FIG. 2 is a developed illustration of the surface of the cylindrical electrode of FIG. 1 according to a preferred embodiment of that electrode.
Figure 3:
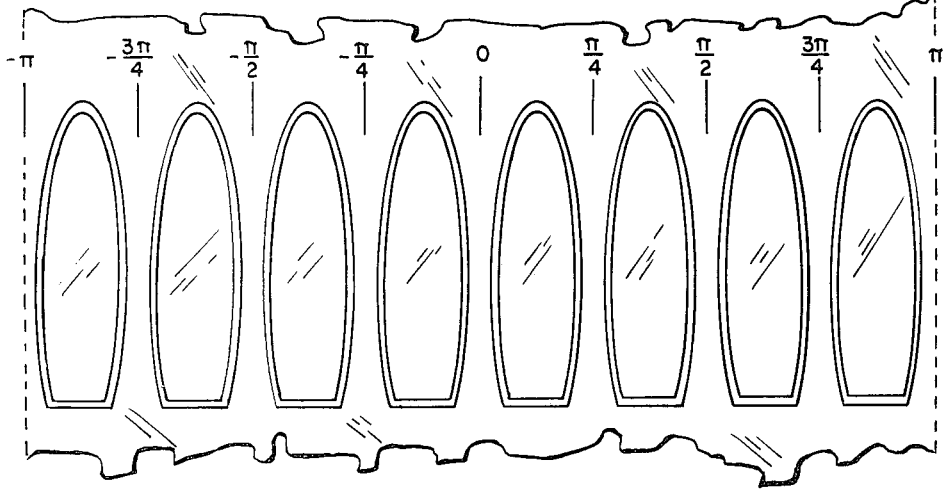
FIg. 3 is a second developed illustration of an electrode structure which could be used in the cylindrical electrode of FIG. 1.

An electron beam *e*, in passing from a cathode 2 to a screen 4, passes through a focusing and deflection cylindrical electrode system 6. Eight electrode segments 10 are arranged at equal angular intervals around the central portion of the cylindrical electrode 6. In FIG. 1, only five of the electrode segments are visible, but FIGS. 2 and 3 provide a developed or unrolled illustration of the central portion of cylindrical electrode 6, thereby illustrating all eight electrodes segments 10. First and second cylindrical electrode sections 12 and 14 are provided at either end of the electrode segments 10, with extensions from these two electrode sections interleaved with the eight electrode segments. As is seen from an examination of the electrode system of FIG. 1, the eight mutually separated electrode segments 10 are arranged as cylindrical segments around the surface of an imaginary cylinder of radius R and angular intervals of $\pi/4$. Opposite segments of the cylindrical segments are diametrically symmetrical with respect to an axis of the imaginary cylinder. Cylindrical sections 12 and 14 also have a radius of substantially R, and each has an axis coincident with the axis of the imaginary cylinder. Extensions at the end of sections 12 and 14 are interleaved or interdigitated with the eight electrode segments. The axially remote ends of sections 12 and 14 are smooth.

As seen in FIGS. 2 and 3, the electrode segments 10 are separated from their surrounding cylindrical sections 12 and 14 by insulating boundaries 16 of finite width. The electrode segments are also preferably insulated from each other. The electrode segments can be cylindrically mounted separately from the electrode sections provided that no dielectric is used on the inner surface of the imaginary cylinder mounting the segments. Alternatively, the segments may be mounted on the inner side of but insulated from sections 12 and 14, in which case the radius R of the imaginary cylinder will be slightly smaller than the radius of substantially R of the two cylindrical sections.

A means 20 must be provided for applying selected voltages to selected electrode segments and sections. The particular voltage chosen for application to each electrode will determine how the electrode system affects the electron beam.

The electrode system can be made to operate as an Einzel lens by proper choice of applied voltage values. Einzel lenses in general are explained more fully in U.S. Pat. No. 3,714,504. If a first voltage $V_0$ is applied to each of the eight electrode segments and a second voltage V is applied to both the electrode sections, the system operates as a simple Einzel lens.

Alternatively, the electrode system can be made to operate as a bipotential lens by application of a first voltage $V_0$ to each of the eight electrode segments, while a second voltage $V_1$ is applied to the first electrode section 12 and a second voltage $V_2$ is applied to the second electrode section 14. In this instance $V_1 \leqq V_0 \leqq V_2$ and preferably $V_1 < V_0 < V_2$.

The electrode system can be used as a beam deflector by applying different voltages to each of the eight electrode segments. Reading in sequence around the cylinder, the electrode segments have the following eight voltages applied to them:

$V_0+aV_y-V_x$
$V_0+V_y-aV_x$
$V_0+V_y+aV_x$
$V_0+aV_y+V_x$
$V_0-aV_y+V_x$
$V_0-V_y+aV_x$
$V_0-V_y-aV_x$
$V_0-aV_y-V_x$

When the electrode system is used in this manner, a is a constant, $V_x$ is a voltage proportional to a desired x-axis deflection, $V_y$ is a voltage proportional to a desired y-axis deflection, and $V_0$ is a voltage of such neutral value that it has no focusing or defocusing effect if applied to the first and second electrode sections. If used, for example, in a typical television cathode-ray tube, $V_x$ and $V_y$ will be sawtooth voltages generated in a conventional manner. The values $-V_x$ and $-V_y$ may be generated by inversion. The values $aV_x$ and $aV_y$ may be generated by amplification with a gain of a. Summers or adders may be used to form the combined values.

If $V_0$ is also applied to both electrode sections while the deflecting values are applied to the eight segments, the electrode system deflects but does not focus the beam. The preferred embodiment of the invention, however, is used for simultaneous deflection and focusing. If one voltage value V sufficient for focusing is applied to both electrode sections while the deflecting values are applied to the eight segments, the electrode system functions by focusing as an Einzel lens while also deflecting the beam. Similarly, if voltages $V_1$ and $V_2$ sufficient for focusing are applied respectively to the first and second electrode sections while the deflecting values are applied to the eight segments, the electrode system functions by focusing as a bipotential lens while also deflecting the beam.

What is claimed is:

1. An electrostatic electrode system for controlling an electron beam comprising:

A. eight mutually separated electrode segments arranged as cylindrical segments around the surface of an imaginary cylinder of radius R at angular intervals of $\pi/r$, opposite segments being diametrically symmetrical with respect to an axis of the imaginary cylinder, B. a first cylindrical electrode section of a radius of substantially R having an axis coincident with the axis of the imaginary cylinder, the first section having first extensions at one end thereof at angular intervals of $\pi/4$, the first extensions being interleaved with and insulated from the eight electrode segments, and the first section extending axially away from the first extensions at the one end thereof to a smooth end of the first section at an axially opposite end thereof, C. a second cylindrical electrode section of a radius of substantially R having an axis coincident with the axis of the imaginary cylinder, the second section having second extensions at one end thereof at angular intervals of $\pi/4$, the second extensions being interleaved with and insulated from the eight electrode segments, and the second section extending axially away from the second extensions at the one end thereof to a smooth end of the second section at an axially opposite end thereof, and D. means for applying voltages for electrostatic control to the segments and sections of the electrode.

* * * * *